United States Patent [19]

Tanishi et al.

[11] Patent Number: 4,566,748

[45] Date of Patent: Jan. 28, 1986

[54] CONNECTOR

[75] Inventors: Tokio Tanishi, Mie; Hideki Yokoyama, Tsu, both of Japan

[73] Assignee: Matsushita Electric Works, Ltd., Osaka, Japan

[21] Appl. No.: 651,259

[22] Filed: Sep. 17, 1984

[51] Int. Cl.[4] ..... H01R 9/24

[52] U.S. Cl. ..... 339/95 D

[58] Field of Search ..... 339/95 D, 113

[56] References Cited

U.S. PATENT DOCUMENTS

| | | | |
|---|---|---|---|
| 3,324,447 | 6/1967 | Pistey | 339/95 D |
| 3,573,713 | 4/1971 | Enright et al. | 339/113 R |
| 4,325,196 | 4/1982 | Gauch et al. | 283/7 |
| 4,397,514 | 8/1983 | Durand et al. | 339/95 D |

FOREIGN PATENT DOCUMENTS 2317040 10/1974 Fed. Rep. of Germany .

OTHER PUBLICATIONS

U.S. News & World Report; Allen Bradley Terminal Blocks; 9–1963.

*Primary Examiner*—Joseph H. McGlynn

*Attorney, Agent, or Firm*—Burns, Doane, Swecker & Mathis

[57] ABSTRACT

A connector comprises an insulating casing of a bottomed box-shape having in the bottom wire-end insert holes, a conductive contact means of an angled tubular shape complementarily inserted into the casing to dispose both open ends of the means substantially adjacent the bottom and opposing open end of the casing, a plurality of conductive resilient means arranged within the contact means to extend between the bottom and the open end of the casing and to respectively align with each of the wire-end insert holes, the resilient means functioning to cause wire ends for interconnection to be urged into contact commonly with the contact means as inserted between the resilient and contact means and simultaneously to be prevented from being pulled out of the contacting position, and a lid secured to the open end of the casing, the respective members being manufactured in a simple manner and assembled by inserting them into the casing in the same direction, rendering the productivity of the connector to be remarkably improved.

12 Claims, 9 Drawing Figures

CONNECTOR

This invention relates to connectors for interconnecting electrical wire ends.

The connectors of the type referred to are arranged so that a contact member is disposed within a casing and the interconnection of wire ends is achieved only by inserting two or more wire ends into the casing, and are useful for the wire interconnection made specifically within joint boxes or various apparatus and equipments involving electric wiring.

DISCLOSURE OF PRIOR ART

Hitherto, the electric wire interconnection has been made by removing insulating coatings from the wire ends, joining or twisting the exposed wire ends together and wrapping them with insulating tape, and thus has been troublesome and remarkably low in the working efficiency. In order to remove such drawbacks, on the other hand, there has been proposed such a connector as disclosed in German Patent Offenlegungsschrift No. 2,317,040, in which a contact member of a conductive material is disposed within a casing diagonally with respect to a direction in which the exposed wire ends are inserted into the casing, and the contact member is formed to have through holes for insertion therethrough of the wire ends and accompanied by a resilient plate member for urging the inserted wire ends into resilient contact with opposing edges of the through holes of the contact member in diagonal relationship thereto, so that the wire ends thus held in the casing can be interconnected with each other through the contact member.

With this arrangement, however, the working efficiency in interconnecting the wire ends could have been improved but the connector productivity has been still insufficient. That is, it is necessary to provide the through holes in the contact member disposed within the casing and secure the resilient plate member to the contact member, and the respective members and casing must be made with high accuracy so that wire end inserting holes made in the casing will align respectively with each of the through holes in the contact member. For achieving improved contact between the wire end and the contact member in their diagonal relationship, further, the contact member and resilient plate member as well have to be formed in a rather complicated shape and the casing has to be adapted to the diagonal disposition of the members, so that the assembling work of them must become also complicated and cannot be easily adapted to be automated.

TECHNICAL FIELD OF THE INVENTION

A primary object of the present invention is, therefore, to provide a connector in which any one of constituent members to be mounted in a casing can be fabricated in easier manner without requiring any high accuracy and can be easily assembled into the casing without requiring any precise positioning in their engaging relationship, allowing thus the members to be sequentially assembled into the casing in a single direction with respect to the casing and their assembling work to be easily adapted to the automation for remarkably improving the productivity as a whole.

According to the present invention, the object can be attained by forming the connector to comprise a substantially box-shaped casing open at one end and bottomed at the other opposing end, the bottom wall having through holes for insertion of wire ends to be interconnected, a contact member formed of a conductive material in an angled tubular shape fitly insertable into the casing from its open end to dispose both open ends of the contact member substantially adjacent the open and bottomed ends of the casing, respectively, a plurality of conductive resilient members inserted into the contact member from the open end of the casing so as to extend in parallel to a direction of inserting the contact member into the casing and to resiliently urge the wire ends inserted through the wire-end insert hole into contact with the contact member, and a lid secured to the open end of the casing.

Other objects and advantages of the present invention shall become clear from the following description of the invention detailed with reference to preferred embodiments shown in accompanying drawings.

Figure 1:
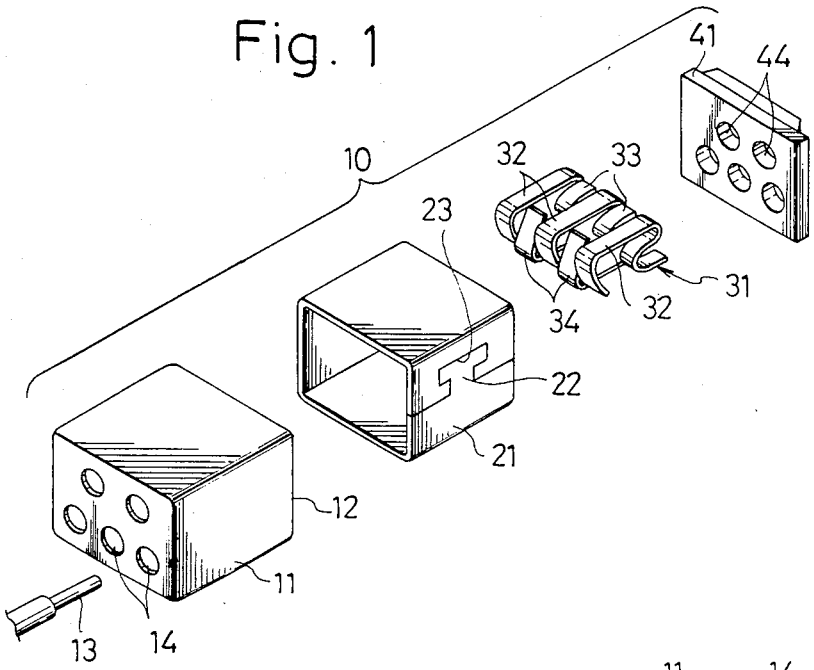
FIG. 1 is a perspective view as disassembled of a connector in an embodiment according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 2:
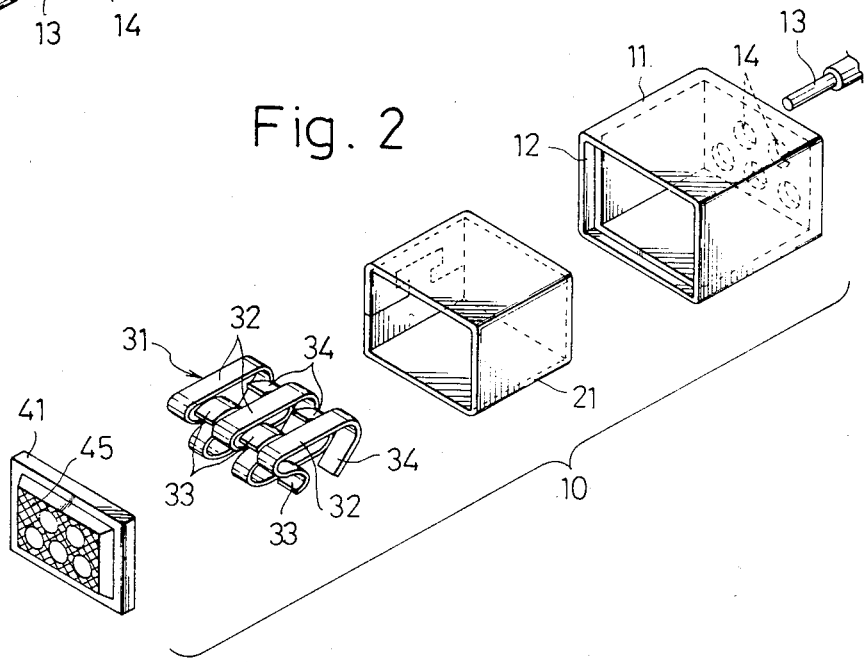
FIG. 2 is a perspective view similar to FIG. 1 but as seen from the side opposite to that of FIG. 1.
Figure 5:
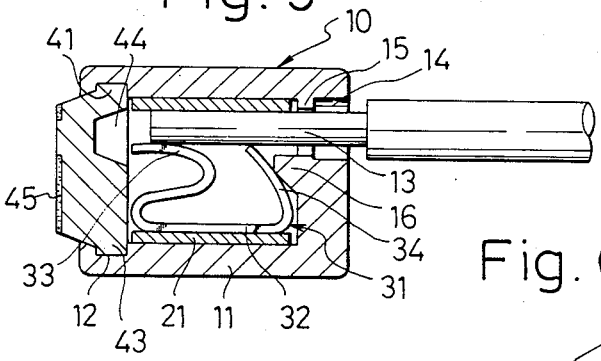
FIG. 5 is a vertically sectioned view of the connector of FIG. 1 as assembled, showing a state in which a wire end is inserted into the connector.

Referring to FIGS. 1 and 2, there is shown a connector 10 of an embodiment according to the present invention, which includes a casing 11 made of a synthetic resin into an angled tubular shape open at one end and closed at the other end, that is, substantially into a bottomed box shape. The casing 11 is provided at its open end with an engaging step 12 and in the other end bottom with a plurality of through holes 14 for inserting therethrough an end 13 of an electric connecting wire into the casing. The insert holes 14 are mutually spaced and, in the present embodiment, they are divided into two lines one of which comprises two holes and the other of which comprises three holes as arranged to be vertically staggered but horizontally aligned. Further, as seen in FIG. 5, it is preferable in this case that each hole 14 is provided at its inner end with a radial projection 15 which extends slightly inward so as to restrict the diameter of the hole to be only slightly larger than that of the connecting wire to be inserted, and that the bottom of the casing 11 is provided on its inner surface with an inward expansion 16 which extends along the hole 14 toward the open end of the casing 11.

A contact member 21 of an electrically conductive material formed into an angled tubular shape complementarily fitted into the casing 11 is inserted therein through the open end of the casing so that the respective open ends of the member 21 will be disposed slightly inside the step 12 and the bottom of the casing 11, respectively. The outer dimensions of the contact member 21 are selected to be substantially equal to the inner dimensions of the casing 11 so that, when the contact member 21 is housed within the casing 11, the respective outer wall surfaces of the member 21 will contact the respective inner wall surfaces of the casing 11. The member 21 itself is made of a strip punched out of an electrically conductive plate and, in the illustrated embodiment, the strip is formed to have at its one end with a T-shaped linkage lug 22 and at the other end with a complementary T-shaped notch 23 during the punching so that the lug 22 can be fitted into the notch 23 to form the angled tubular shape.

The connector 10 of the present invention further comprises a plurality of conductive resilient members 31 mounted inside the contact member 21. These resilient members 31 correspond in number to the wire-end inserting holes 14 in the bottom of the casing 11, that is, five in the illustrate embodiment, and are respectively made by bending an elongate resilient metal plate into a configuration having a flat extending central portion 32, S-shaped spring portion 33 at one end and wedge portion 34 bent straight at the other end to the same side as the spring portion 33. The five resilient members 31 are inserted as juxtaposed into the contact member 21 through the open end of the casing so that their flat central portions 32 will extend in the inserting direction to lie between the both open ends of the contact member 21, with their wedge portions 34 all rested against the bottom of the casing 11 but alternately oppositely directed to each of opposing side walls of the contact member 21.

More particularly, in the present instance employing the five resilient members 31, three of them positioned middle and both outermost sides in the juxtaposed arrangement are placed downward to dispose the flat portion 32 above and the spring and wedge portions 33 and 34 below, whereas remaining two between the respective three are placed upward to dispose the flat portion 32 below and the spring and wedge portions 33 and 34 above in FIG. 1 or 2. With such arrangement, the spring and wedge portions 33 and 34 of each of the three downward placed members 31 are disposed to oppose each of the three inserting holes 14 in the lower positioned line of the holes in the bottom of the casing 11, while the portions 33 and 34 of each of the two upward placed members 31 are disposed to oppose each of the two insert holes in the upper positioned line of the holes. It will be clear when FIG. 5 is also referred to that the wire end 13 inserted into the casing 11 through one of the holes 14 against the resiliency of the spring and wedge portions 33 and 34 can be firmly pressed against one of the opposing side walls of the contact member 21 by the resiliency, while the wedge portion 34 bent inward to allow the wire end 13 to be smoothly inserted will engage edgewise with the wire end 13 so as to resist against opposite directional pulling force and thus to prevent the inserted wire end from being easily pulled out of the inserted and pressed position.

Figure 3:
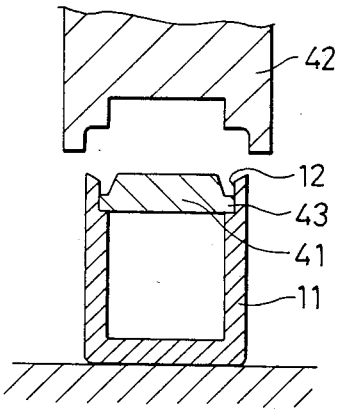
FIGS. 3 and 4 are cross sections for explaining how the lid is secured to the open end of the casing in the connector of FIG. 1.
Figure 4:
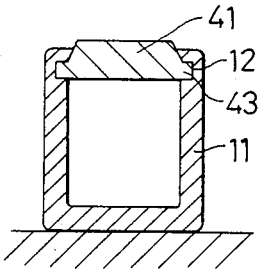

A plate shaped lid 41 of an insulating material is then fitted to the open end of the casing 11 containing therein the foregoing respective members to close the end. In this embodiment, the lid 41 is seated on the engaging step 12 provided in the open end of the casing 11, and peripheral end edge around the step 12 is deformed as, for example, heated by an ultrasonic wave horn 42 fitted from above as shown in FIG. 3 so as to tightly clamp a flange portion 43 of the lid with the deformed end edge as shown in FIG. 4. The lid 41 is provided at its inner surface with recesses 44 which are five in the present embodiment at positions opposing to the wire-end inserting holes 14 in the bottom wall of the casing 11 so as to be able to receive tip ends of the wire ends 13 inserted.

The lid 41 is preferably made of a transparent synthetic resin and a satin-like finish 45 is applied to the outer surface of the lid except for positions corresponding to the recesses 44, so as to reduce the transparency of the lid while allowing the interior of the casing 11 to be seen only through the positions left transparent, whereby the tip ends of the wire ends 13 inserted into the casing 11 through the holes 14 and resilient members 31 to the recesses 44 can be easily observed from the exterior of the lid 41 and the interconnection of the wire ends 13 may be easily confirmed.

The assembling and operation of the above described connector 10 according to the present invention shall be referred to as summarized with reference to FIGS. 1 to 5. As will be obvious from the above description, the contact member 21 is inserted into the casing 11 of the connector 10 in the direction from its open end to the bottom end and then the plurality of resilient members 31 are assembled within the contact member 21 as also inserted in the same direction of inserting the member 21. In this assembling, the wedge portions 34 of the resilient members 31 are placed on the bottom end side of the casing 11, with their flat portions 32 extended in parallel to the inserting direction and their spring and wedge portions 33 and 34 directed alternately in opposite direction to that of adjacent one of the members 31 as aligned respectively with each of the wire-end inserting holes 14. In this case, it will be readily appreciated that the height of the bent ends of the resilient members 31 is so set that, when the members are inserted into the contact member 21, the bent ends can firmly press the inserted wire end 13 against the opposing inner side wall of the contact member 21 to achieve sufficient electric contact between them. Finally, the lid 41 is secured to the open end of the casing 11 to complete the assembling of the connector. In the connector 10 according to the present invention, therefore, the contact member 21, resilient members 31 and lid 41 are assembled into the casing 11 sequentially in a single direction with respect to the casing 11 so that, as will be readily understood by those skilled in the art, an automatic assembling operation of the connector 10 can be easily realized.

In inserting the wire end 13 into the thus assembled connector 10 through one of the inserting holes 14, the wire end 13 is effectively guided by the radial projection 15 of the hole 14 to enter as pinpointed between the inner side wall of the contact member 21 and the free ends of the wedge portion 34 and of the spring portion 33 and into the recess 44 of the lid 44, and the wire end 13 can be firmly pressed against the inner side wall of the contact member 21 to achieve a sufficient contacting pressure with the resilient force of the spring and wedge portions 33 and 34, while being subjected to a strong wedge action of the wedge portion 34 which ensures to prevent any separation of the wire end from the connector. In this connection, the wedge portion 34 abuts at its outer side against the expansion 16 provided on the bottom of the casing 11 so that the wedge portion 34 will be assisted by the expansion 16 so as not to bow even with a pulling force but to rather increase the wedge action with increased edgewise biting with respect to the wire end.

With the above arrangement, the contact member 21 expands with a relatively wide planar zone with respect to the wire end 13 and the resilient member 31 can provide a large contacting zone to the length of the wire end inserted. Therefore, the present invention can reliably realize the interconnection between the wire lines without requiring such relatively high manufacturing accuracy for the constituent parts as in the known connectors. Yet, the present invention involves no specific positioning and interlocking arrangement for the constituents so that, in association with the easier manufacturing and simpler assembling works of the constituents, the invention allows the connector to be manufactured at a high productivity on mass production basis and thus at a remarkably low cost.

Figure 6:
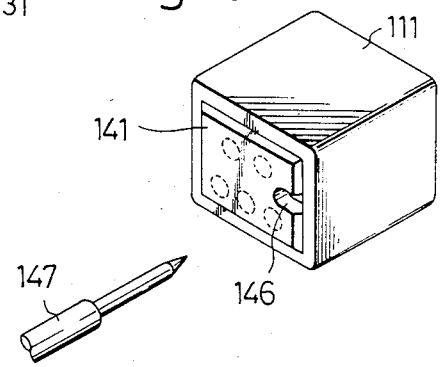
FIG. 6 is a perspective view as assembled of another embodiment of the connector according to the present invention.

Referring to another embodiment shown in FIG. 6, a lid 141 is provided at one side edge with a notch 146 so that a through hole will be provided when the lid is secured to the casing 111 and interconnected state of the wire ends 13 can be checked by inserting a tester probe 147 into the connector through the notch 146. In this case, the tester probe 147 is inserted in the direction opposite to that of inserting the wire end 13 and thus the test can be smoothly conducted. Other arrangement, operation and effect in this embodiment are substantially the same as those in the foregoing embodiment.

Figure 7:
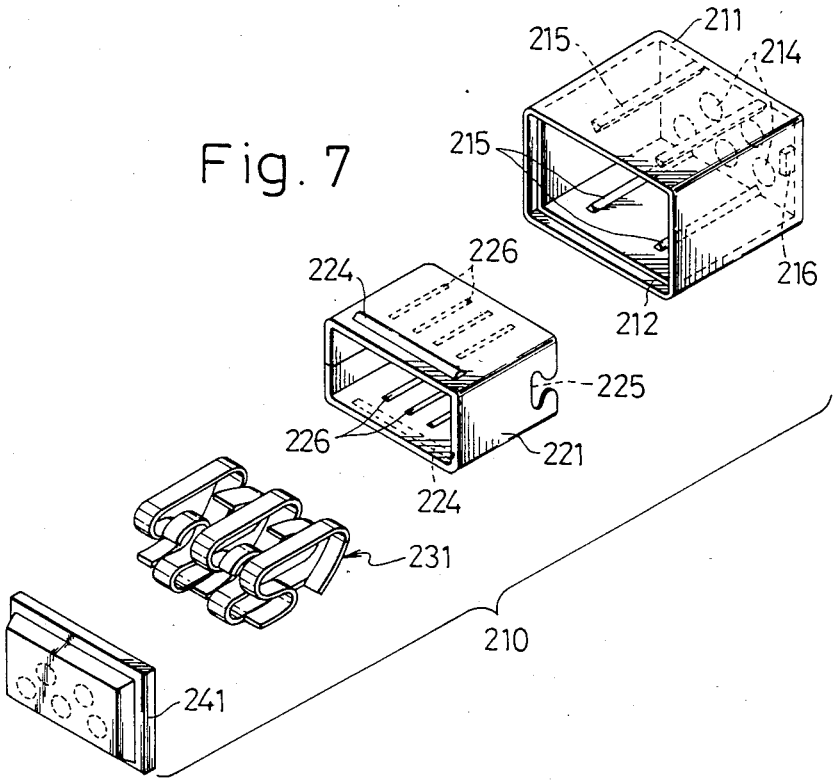
FIG. 7 is perspective view as disassembled of still another embodiment of the connector according to the present invention.

FIG. 7 shows still another embodiment of the connector according to the present invention, wherein constituent members similar to those in the embodiment of FIGS. 1 to 5 are denoted by the same reference numerals but added by 200. In the present embodiment, as illustrated, a casing 211 is provided on each of opposing inner side walls with a plurality of raised supporting ribs 215 extended in the inserting direction of a contact member 221 so that, even if there is a clearance between the casing 211 and the contact member 221, the contact member 221 can be stably held within the casing 211 without any movement. On the other hand, the contact member 221 is provided on its outer opposing side walls with projected reinforcing ribs 224 in the vicinity of each longer edge at one end of the member onto which a lid 241 is to be secured, so as to reinforce the side walls for preventing them from being warped outward by the wire ends inserted and even to restrict any expansion of the contact member 221 with abutment of ribs 224 against the inner side wall surfaces of the casing 211. Further, there is provided inside the casing 211 a positioning projection 216 in the vicinity of the bottom end, while the contact member 221 is provided with a notch 225 fittable to the projection 216,so that the contact member 221 may be fully inserted into the casing 211 only when the projection 216 engages in the notch 225 and inserting posture of the contact member 221 into the casing may be restricted always to be one. Further, it is preferable that the contact member 221 is provided on the inner surfaces of the opposing side walls with a plurality of guide ribs 226 which extend in the direction of inserting the resilient members 231 into the contact member 221, whereby the assembling insertion of the resilient members 231 into the contact member 221 is smoothly guided to render the assembling work to be more easier and the respective resilient members may be kept in the juxtaposed arrangement as properly separated from each other.

Other arrangement, operation and effect of the embodiment of FIG. 7 are substantially the same as those of the embodiment of FIGS. 1 to 5.

Figure 8:
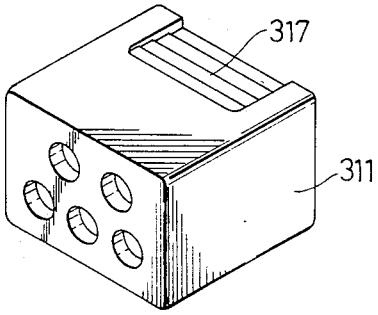
FIGS. 8 and 9 are perspective views showing further different embodiments of the connector according to the present invention.
Figure 9:
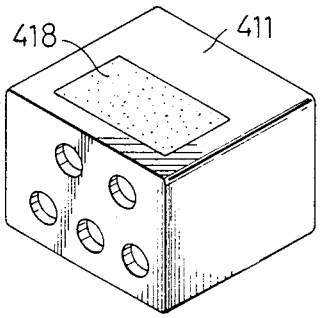

FIGS. 8 and 9 show other different embodiments of the connector according to the present invention respectively. In FIG. 8, the casing 311 is formed to have at each of the outer surfaces of the opposing longer side walls a plurality of shallow steps 317 to provide an anti-slip function for easier finger gripping. That is, the steps 317 can be used as a finger engaging portion at the time of inserting the wire end. In the case of FIG. 9, a roughened surface part 418 is provided at a proper position on a casing 411, for example, on one of the opposing longer side walls of the casing, so that any required marking for the wire interconnection may optimumly made on the roughened surface part 418 so as not to be readily erased by finger touching during the wire end inserting work. Other arrangement, operation and effect of these embodiments of FIGS. 8 and 9 are substantially the same as those of the embodiment of FIGS. 1 to 5.

The present invention can be modified in various manners. That is, the number of the wire-end insert holes and resilient members can be increased or decreased as occasion demands. Even in the case where the wire-end insert holes are provided in the lid instead of the casing and the recesses for receiving the tip ends of the wires are provided in the casing, substantially the same operation as in the above embodiments can be achieved so long as the resilient members are inserted to dispose their wedge portions on the lid side. In securing the lid to the casing, they may be joined simply with a bonding agent. Further, the shape of the casing and contact member is not restricted to such rectangular angled tubular shape as shown, or to the complementary relationship to each other, but any shape can be employed. For example, the casing may even be cylindrical, in which event the contact member in an angled tubular shape may be housed within the casing in an immovable state achieved by means of proper ribs provided to either one or both of the casing and contact member.

What is claimed as our invention is:

1. A connector comprising a casing of a tubular shape open at one end and bottomed at the other end, contact means of a tubular shape having both open ends and assembled inside said casing with said both open ends disposed adjacent said open and bottomed ends of the casing, a plurality of resilient means arranged within said contact means to be in parallel to a direction of inserting the contact means into the casing for holding respective wire ends to be interconnected at a position between said resilient means and an inner surface of the contact means, a lid secured to said open end of the casing, and means provided in one of the bottomed end of the casing and said lid to be opposed to respective said resilient means for inserting said wire ends respectively into said holding position, said resilient means comprising respectively an elongate strip bent to have at one end of a central flat portion an S-shaped resilient portion and at the other end of said flat portion a wedge portion sloped to be on the side of said resilient portion, said wire ends respectively being held resiliently in said holding position by free ends of said resilient and wedge portions.

2. A connector according to claim 1, wherein said plurality of resilient means are arranged respectively to direct said free ends of said resilient and wedge portions alternately to each of opposite sides with respect to said central flat portion, and said inserting means is disposed on each of said opposite sides.

3. A connector according to claim 1, wherein said lid is provided at its edge with a notch which defines a through hole for insertion of a tester probe when the lid is secured to said casing.

4. A connector according to claim 1, wherein said casing is provided at its inner surface with a supporting rib for engaging with said contact means, and the contact means is provided with a reinforcing rib.

5. A connector according to claim 1, wherein said casing is provided therein with a projection in the vicinity of said bottomed end, and said contact means is provided at a position corresponding to said projection with a notch for engaging with the projection.

6. A connector according to claim 1, wherein said casing is provided at its outer surface with a shallow stepped portion.

7. A connector according to claim 1, wherein said casing is roughened at its outer surface.

8. A connector according to claim 1, wherein said inserting means is provided in said bottomed end of said casing, and said lid is made of a transparent synthetic resin roughened on the outer surface except for portions opposing to the inserting means of the casing.

9. A connector according to claim 8, wherein recesses for receiving tips of said wire ends inserted are formed in said lid at positions opposing to said inserting means of said casing.

10. A connector comprising a casing of a tubular shape open at one end and bottomed at the other end, contact means of a tubular shape having both open ends and assembled inside said casing with said both open ends disposed adjacent said open and bottomed ends of the casing, a plurality of resilient means arranged within said contact means to be in parallel to a direction of inserting the contact means into the casing for holding respective wire ends to be interconnected at a position between said resilient means and an inner surface of the contact means, a lid secured to said open end of the casing, and means provided in one of the bottomed end of the casing and said lid to be opposed to respective said resilient means for inserting said wire ends respectively into said holding position, said lid provided at its edge with a notch which defines a through hole for insertion of a tester probe when the lid is secured to said casing.

11. A connector according to claim 10, wherein said resilient means comprises respectively an elongate strip bent to have at open end of a central flat portion an S-shaped resilient portion and at the other end a wedge portion sloped to be on the side of said resilient portion, said wire ends respectively being held resiliently in said holding position by free ends of said resilient and wedge portions.

12. A connector comprising a casing of a tubular shape open at one end and bottomed at the other end, contact means of a tubular shape having both open ends and assembled inside said casing with said both open disposed adjacent said open and bottomed ends of the casing, a plurality of resilient means arranged within said contact means to be in parallel to a direction of inserting the contact means into the casing for holding respective wire ends to be interconnected at a position between said resilient means and an inner surface of the contact means, a lid secured to said open end of the casing, and means provided in one of the bottomed end of the casing and said lid to be opposed to respective said resilient means for inserting said wire ends respectively into said holding position, said casing is provided at its inner surface with a supporting rib for engaging with said contact means, and the contact means is provided with a reinforcing rib.

* * * * *